US010249995B2

(12) United States Patent
Zebhauser et al.

(10) Patent No.: US 10,249,995 B2
(45) Date of Patent: Apr. 2, 2019

(54) SELF-CLOSING CONTACT SLEEVE

(71) Applicant: Rosenberger Hochfrequenztechnik GmbH & Co. KG, Fridolfing (DE)

(72) Inventors: Martin Zebhauser, Laufen (DE); Manuel Pemwieser, Burghausen (DE); Christian Anfang, Bergen (DE)

(73) Assignee: ROSENBERGER HOCHFREQUENZTECHNIK GMBH, Fridolfing (DE)

( * ) Notice: Subject to any disclaimer, the term of this patent is extended or adjusted under 35 U.S.C. 154(b) by 0 days.

(21) Appl. No.: 15/750,898

(22) PCT Filed: Feb. 26, 2016

(86) PCT No.: PCT/EP2016/054123
§ 371 (c)(1),
(2) Date: Feb. 7, 2018

(87) PCT Pub. No.: WO2017/144121
PCT Pub. Date: Aug. 31, 2017

(65) Prior Publication Data

US 2018/0233866 A1 Aug. 16, 2018

(51) Int. Cl.

| | |
|---|---|
| ***H01R 13/05*** | (2006.01) |
| ***H01R 13/11*** | (2006.01) |
| ***H01R 24/40*** | (2011.01) |
| ***H01R 24/44*** | (2011.01) |
| ***H01R 103/00*** | (2006.01) |
| ***H01R 13/627*** | (2006.01) |

(52) U.S. Cl.
CPC ..... *H01R 24/44* (2013.01); *H01R 13/052* (2013.01); *H01R 13/111* (2013.01); *H01R 13/6277* (2013.01); *H01R 24/40* (2013.01); *H01R 2103/00* (2013.01)

(58) Field of Classification Search
CPC ..... H01R 2103/00; H01R 9/05; H01R 24/40; H01R 24/44; H01R 13/052; H01R 13/111; H01R 13/6277
USPC ..... 439/578–585
See application file for complete search history.

(56) References Cited

U.S. PATENT DOCUMENTS 4,932,897 A * 6/1990 Lee ..... H01R 24/40 439/578
5,074,809 A * 12/1991 Rousseau ..... H01R 24/44 439/578
5,556,292 A 9/1996 Kato
(Continued)

FOREIGN PATENT DOCUMENTS

DE 19913898 C1 1/2001
DE 102005026030 A1 1/2006
(Continued)

OTHER PUBLICATIONS

Machine translation of FR1279360A.

*Primary Examiner* — Gary F Paumen
(74) *Attorney, Agent, or Firm* — David P. Dickerson

(57) ABSTRACT

The present invention relates to a contact sleeve for an external conductor of a first connector of an HF plug connection which has a front-side region having at least one slot, wherein the slot has dimensions such that the front-side region closes itself when the contact sleeve is connected to a second connector.

12 Claims, 3 Drawing Sheets

(56) References Cited

U.S. PATENT DOCUMENTS

| | | | | |
|---|---|---|---|---|
| 6,364,681 | B1 * | 4/2002 | Watanabe | H01R 13/625 439/335 |
| 6,439,925 | B1 | 8/2002 | Lin | |
| 2011/0237123 | A1 * | 9/2011 | Burris | H01R 13/6277 439/578 |

FOREIGN PATENT DOCUMENTS

| | | | |
|---|---|---|---|
| EP | 1641086 | B1 | 1/2007 |
| FR | 1279360 | A | 12/1961 |

* cited by examiner

SELF-CLOSING CONTACT SLEEVE

FIELD OF THE INVENTION

The present invention relates to a contact sleeve for an external conductor of a coaxial plug connection.

DESCRIPTION OF THE PRIOR ART

EP 1 641 086 B1 discloses a plug connector which can be operated with reduced plugging forces. In this regard, a plug connector with a radial, split ring is described, wherein the ring widens radially when the plug connector is plugged in.

SHORT DESCRIPTION OF THE INVENTION

Against this background, the object of the present invention is to provide a plug connection with improved electrical properties.

According to the invention, this object is achieved by a contact sleeve for an external conductor of a high-frequency plug connection having the features of Patent claim 1 and/or by an HF plug connection having the features of Patent claim 10.

Accordingly, the following is provided:

- a contact sleeve for an external conductor of a first connector of an HF plug connection which has a front-side region having at least one slot, wherein the slot has dimensions such that the front-side region closes itself when the contact sleeve is connected to a second connector.

The idea on which the present invention is based consists in designing a contact sleeve for an external conductor of a first connector in such a way that, when plugged in, a front-side region of the contact sleeve is designed so that it is as circumferential as possible, i.e. with essentially no interruptions.

According to the invention, the slot of the front-side region is designed in such a way that it closes itself when connected to a second connector.

Accordingly, the contact sleeve according to the invention ensures a more homogeneous distribution of the impedance as well as improved electromagnetic compatibility (EMC) characteristics through an essentially circumferential front-side region when the contact sleeve is situated in the plugged-together state.

It should be understood that the description "circumferential front-side region" refers to a plugged-together state of the contact sleeve.

Advantageous embodiments and developments are apparent from the further subclaims and from the description with reference to the drawings.

According to a preferred embodiment of the invention, the slot of the contact sleeve is designed in such a way that plugging forces are reduced when the first connector is connected to a second connector of an HF plug connection, and tolerance compensation is provided.

By virtue of the slot, plugging forces required to connect the contact sleeve to a second connector can be reduced, compared with a contact sleeve having a front-side region with no slot.

The contact sleeve according to the invention moreover provides a tolerance compensation to the extent that too large a size of the front-side region or too small a size is compensated by the opposite sides of the slot shifting relative to each other in the plugged-together state and a gap remaining between the opposite sides of the slot.

A person skilled in the art will understand the term "self-closing" to mean that the opposite sides of the slot move towards each other when the contact sleeve is connected to a second connector and ideally contact each other. However, a person skilled in the art is aware that, owing to possible manufacturing tolerances, it is possible for a residual small gap between the opposite sides of the slot not to close completely.

According to a further preferred embodiment, the contact sleeve has a spring region with at least one recess which is configured so as to provide deformability of the spring region and to further reduce the plugging forces.

By virtue of the spring region according to the invention, the flexibility and deformability of the contact sleeve is further increased by the recesses of the spring region ensuring that the front-side region shifts with respect to the spring region. This is particularly advantageous in the case of small plug connections with particularly low plugging forces.

According to a further preferred embodiment, the front-side region has an annular design and the slot is angled with respect to a longitudinal axis of the contact sleeve, wherein the longitudinal axis and the slot enclose an angle between 15° and 60°, in particular between 30° and 50°, in particular an angle of essentially 45°. The angling of the slot relative to the longitudinal axis of the contact sleeve brings particular mechanical advantages with respect to the tolerance compensation. Accordingly, when the slot is angled by 45° relative to the longitudinal axis, maximum tolerance compensation of the diameter can be ensured by a reduction of the risk of the opposite sides of the slot becoming tilted and the ability of the opposite sides of the slot to shift relative to each other particularly easily.

According to a further preferred embodiment, the spring region has, on an outer surface thereof, a raised portion which is configured so as to provide an electrical contact with the second connector and which is arranged in particular radially adjacent to the recess. Two external conductors to be connected of a first connector and of a second connector can thus be contacted in a particularly simple fashion. In addition, contacts of this type prove to be particularly fail-safe even when vibrations or shocks occur.

According to a further preferred embodiment, the contact sleeve has at least two recesses, in particular at least four recesses, more particularly at least six recesses. A person skilled in the art understands that both the number of recesses and their geometrical dimensions are provided depending on the size of the contact sleeve.

According to a further preferred embodiment, the front-side region of the contact sleeve tapers towards the front side. As a result, the plugging force that needs to be applied to connect the contact sleeve to a second connector is further reduced.

An HF plug connection having a first connector and a second connector is particularly advantageous, the first connector having a contact sleeve according to the invention and the contact sleeve being designed as an external conductor.

According to a preferred embodiment of an HF plug connection according to the invention, the first connector is designed as a plug and the second connector as a socket. However, a person skilled in the art will understand that non-male/female connectors are also included within the scope of protection of this patent application. Furthermore, a person skilled in the art will understand that a contact sleeve according to the invention can also form part of a socket.

According to a preferred embodiment of the HF plug connection according to the invention, the second connector has latching means which are suitable for latching to the raised portion. The latching means can, for example, be designed as a depression corresponding to the raised portion. The reliability of the contact can thus be further improved.

The above embodiments and developments can, where appropriate, be combined with each other in any form. Further possible embodiments, developments and implementations of the invention also comprise combinations not explicitly mentioned of features of the invention which are described above or below with respect to the exemplary embodiments. In particular, a person skilled in the art will here also add individual aspects as improvements or supplements to the respective basic form of the present invention.

DESCRIPTION OF THE DRAWINGS

The present invention is explained in detail below with the aid of the exemplary embodiments provided in the schematic drawings, in which.

Figure 1:
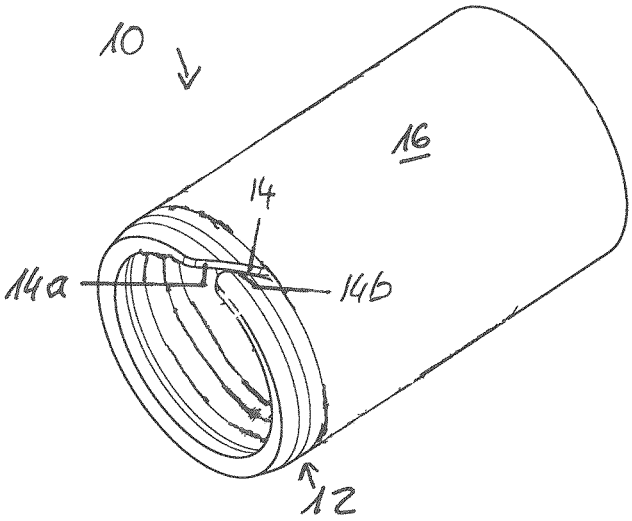
FIG. 1 shows a perspective view of a contact sleeve according to the invention.

The attached drawings are intended to enable further understanding of the embodiments of the invention. They illustrate embodiments and, together with the description, serve to explain principles and concepts of the invention. Other embodiments and many of the advantages mentioned are apparent from the drawings. The elements of the drawings are not necessarily shown to scale.

Identical, functionally similar elements, features and components and those with the same effect are in each case provided with the same reference numerals in the drawings.

DESCRIPTION OF EXEMPLARY EMBODIMENTS

Although the present invention has been described completely above with the aid of preferred exemplary embodiments, it is not restricted thereto and instead can be modified in many different fashions.

FIG. 1 shows a perspective view of a contact sleeve 10 according to the invention. The contact sleeve 10 has a front-side region 12 having a slot 14. The slot 14 is bounded by opposite sides 14*a* and 14*b*. The geometric dimensions of the slot 14 are dimensioned in such a way that the opposite sides 14*a*, 14*b* of the slot 14 move towards each other if the front-side region 12 is pressed together.

In FIG. 1, the front-side region 12 of the contact sleeve is mounted on the barrel region 16. For this purpose, the barrel region 16 of the contact sleeve 10 has a circumferential groove (not shown) within which the front-side region is guided. By virtue of the releasable connection between the front-side region 12 and the barrel region 16, the ability of the front-side region 12 to deform and move relative to the barrel region 16 is ensured sufficiently.

Figure 2:
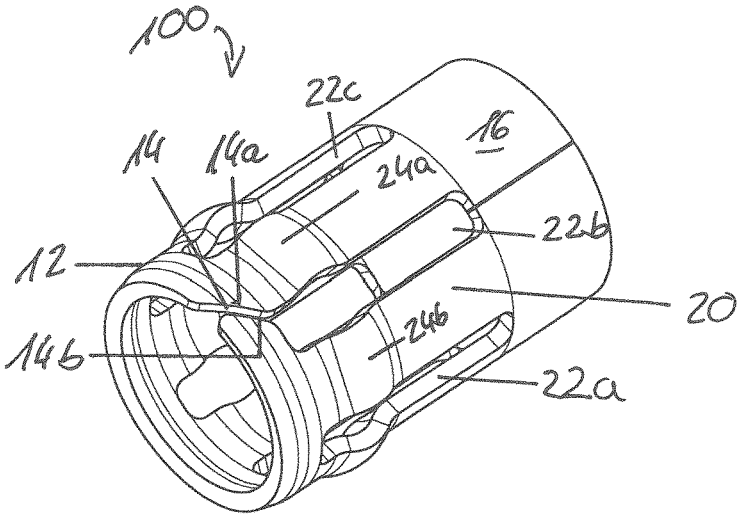
FIG. 2 shows a perspective view of a contact sleeve according to the invention.
Figure 3:
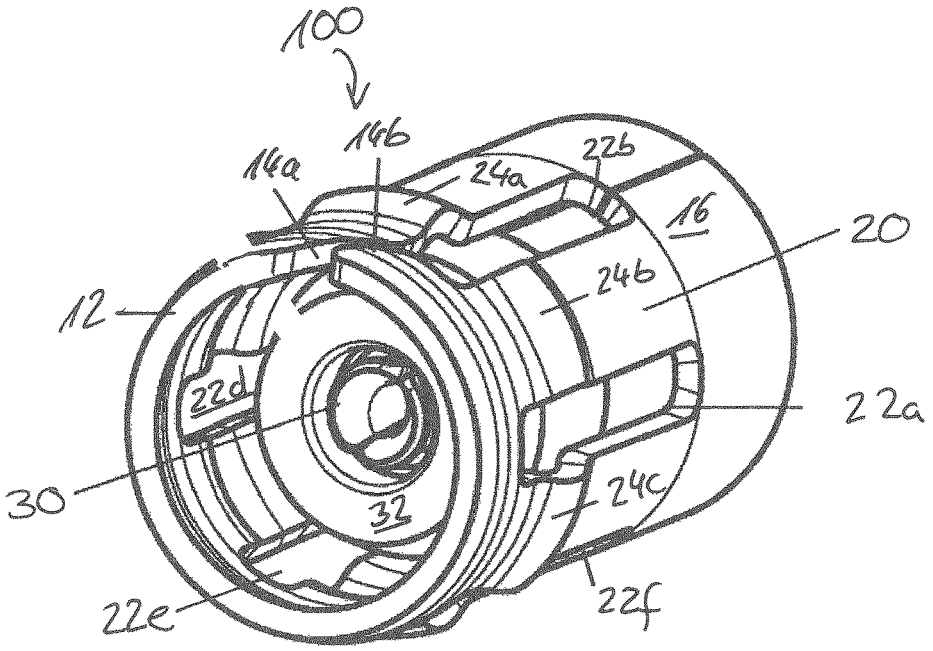
FIG. 3 shows a perspective view of a contact sleeve according to the invention.

FIGS. 2 and 3 are described below in general. FIGS. 2 and 3 each show a perspective view of a contact sleeve 100 according to the invention.

As already described in FIG. 1, the contact sleeve 100 also has a slot 14 which is bounded by opposite sides 14*a* and 14*b*. The slot 14 is arranged in a front-side region 12 of the contact sleeve 100. The front-side region 12 of the contact sleeve 100 is designed as a single piece with a barrel region 16 of the contact sleeve 100.

The barrel region 16 has a spring region 20 with the recesses 22*a-f* and with the raised portions 24*a-f*. The recesses 22*a-f* ensure a sufficient deformability of the contact sleeve 100.

In order to further increase the deformability of the contact sleeve 100, the slot 14 is connected to the recess 22*b* of the spring region 20.

Between the recesses 22*a-f*, the contact sleeve 100 in each has raised portions 24*a-f* which, in the plugged-together state, ensure electrical contact with an external conductor of a second connector 40. The raised portions are situated on the outer surface of the contact sleeve. A person skilled in the art understands that the arrangement of the raised portions 24*a-f* is in no way restricted to an arrangement between the recesses 22*a-f*. In particular, the raised portions can also be arranged in the front-side region 12 or between the front-side region 12 and the spring region 20.

An internal conductor 30 and an insulating part 32 are also shown in FIG. 3, next to the contact sleeve 100. The insulating part 32 is designed as a plastic ring.

Figure 4:
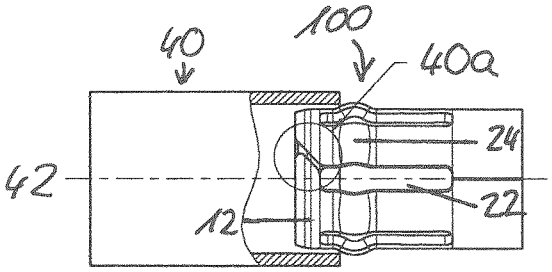
FIG. 4 shows a view in section of an HF plug connection according to the invention.
Figure 4A:
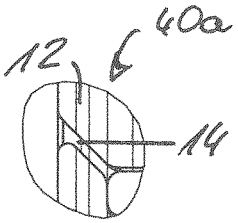
FIG. 4*a* shows a part of FIG. 4.
Figure 5:
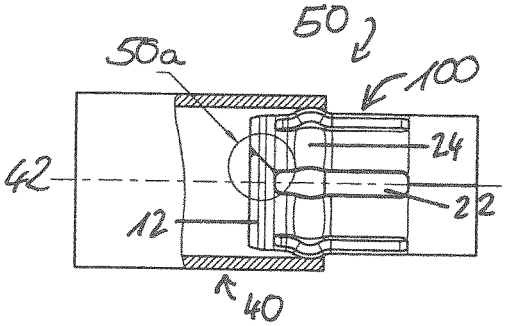
FIG. 5 shows a view in section of an HF plug connection according to the invention.

FIGS. 4, 4*a* and 5 are described in general below. FIGS. 4 and 5 each show a view in section of a contact sleeve 100 and a second connector 40.

FIG. 4 shows the contact sleeve 100 and the second connector 40 in the unplugged state. The partial region 40 in FIG. 4*a* shows that the front-side region 12 of the contact sleeve 100 has a slot 14.

Figure 5A:
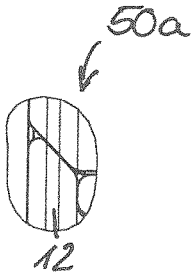
FIG. 5*a* shows a part of FIG. 5.

The contact sleeve 100 and the second connector 40 are shown in the plugged-together state in FIGS. 5 and 5*a*. It can be clearly seen that the slot 14 in FIG. 4 and FIG. 4*a* has closed in FIGS. 5 and 5*a*.

LIST OF REFERENCE NUMERALS

10 contact sleeve
100 contact sleeve
12 front-side region
14 slot
14*a* slot side
14*b* slot side
16 barrel region
20 spring region
22*a-f* recess
24*a-f* raised portion
30 internal conductor
32 insulating part
40 second connector
40*a* region
42 longitudinal axis
50 HF plug connection
50*a* region

The invention claimed is:

1. A connector, comprising:

a first terminal connector comprising a slot and a raised portion; and a second terminal connector comprising a receptacle that receives said first terminal connector, wherein in a disengaged state of said first terminal connector and said second terminal connector, a distal end of said slot is open, in a coaxially engaged state of said first terminal connector and said second terminal connector, in which engaged state said raised portion contacts an inner wall of a distal opening of said receptacle, said distal end of said slot is closed, and at least a portion of said slot is angled with respect to a longitudinal axis of said first terminal connector by an angle selected from the group consisting of:

an angle between 15° and 60°, an angle between 30° and 50°, and an angle of essentially 45°.

2. The connector of claim 1, comprising:

a conductor coaxial to and electrically insulated from said first terminal connector.

3. The connector of claim 1, wherein:

said raised portion that is distanced from said distal end of said slot by at least a width of said raised portion.

4. The connector of claim 3, wherein:

said first terminal connector is tapered, at said distal end of said slot, to a radius that is smaller than a radius of said first terminal connector adjacent to said raised portion and on a proximal side of said raised portion.

5. The connector of claim 3, wherein:

said raised portion extends in a generally circumferential direction of said first terminal connector, and said slot separates segments of said raised portion.

6. An HF connector, comprising:

a contact sleeve comprising a slot and a raised portion, a longitudinal axis of a first portion of said slot being generally parallel to a longitudinal axis of said contact sleeve, a longitudinal axis of a second portion of said slot being angled with respect to said longitudinal axis of said contact sleeve, wherein said contact sleeve is tapered, at a distal end of said contact sleeve, to a radius that is smaller than a radius of said contact sleeve adjacent to said raised portion and on a proximal side of said raised portion.

7. The HF connector of claim 6, wherein:

said first portion has a first width in a circumferential direction of said contact sleeve, said second portion of said slot has a second width in a circumferential direction of said contact sleeve, and said second width is smaller than said first width.

8. The HF connector of claim 6, wherein:

said second portion extends to said distal end of said contact sleeve.

9. The HF connector of claim 6, wherein:

said longitudinal axis of a second portion of said slot is angled with respect to said longitudinal axis of said contact sleeve by an angle selected from the group consisting of:

an angle between 15° and 60°, an angle between 30° and 50°, and an angle of essentially 45°.

10. The HF connector of claim 6, comprising:

a conductor radially inward of, coaxial to and electrically insulated from said contact sleeve.

11. The HF connector of claim 6, wherein:

said raised portion is distanced from said distal end by at least a width of said raised portion.

12. The HF connector of claim 6, wherein:

said raised portion extends in a generally circumferential direction of said contact sleeve, and said slot separates segments of said raised portion.

* * * * *